United States Patent [19]

Chang

[11] 4,013,333

[45] Mar. 22, 1977

[54] WIRE CONNECTOR

[76] Inventor: Te-Hsing Chang, No. 4-1, Lane 125, I Tung Street, Taipei, China /Taiwan

[22] Filed: Sept. 30, 1975

[21] Appl. No.: 618,746

[52] U.S. Cl. ..... 339/98; 339/100

[51] Int. Cl.[2] ..... H01R 11/20

[58] Field of Search ..... 339/97 R, 97 C, 97 P, 339/98, 100

[56] References Cited

UNITED STATES PATENTS

| | | | |
|---|---|---|---|
| 2,952,832 | 9/1960 | Chandler | 339/100 |
| 2,970,184 | 1/1961 | Blonder | 339/97 R X |
| 3,317,883 | 5/1967 | Gourley et al. | 339/100 X |
| 3,745,228 | 7/1973 | Vogt | 339/98 X |
| 3,786,173 | 1/1974 | Vogt | 339/100 X |

*Primary Examiner*—Roy Lake
*Assistant Examiner*—Howard N. Goldberg
*Attorney, Agent, or Firm*—Burns, Doane, Swecker & Mathis

[57] ABSTRACT

A wire connector comprising an outer socket and an inner socket, both of which being tubular shaped and formed of insulating material and adapted to be inserted one into the other. The inner socket has a split extending longitudinally along its full length. A double ended needle is prelaid in the center of the inner socket by being retained in a partition wall therein. The wire ends to be connected are inserted into opening of the inner socket, so that the needle ends penetrate into the cores of the wire ends. The outer socket serves to tighten the inner socket to obtain a positive gripping of the wire ends. A U-shaped spike is provided through the side wall of the inner socket, with two points thereof penetrating the coating of the wires to enhance the connecting effect.

4 Claims, 8 Drawing Figures

A-A

B-B

WIRE CONNECTOR

FIELD OF INVENTION

The present invention relates generally to a wire connector and more particularly to a wire connector comprising two concentric sockets adapted to be assembled one into the other.

BACKGROUND OF INVENTION

Usually when connecting electric wires using either a conventional wire connector or wire joint, one shall have to first strip off the insulating coat of the wire. After connection, insulating tape is used to wrap the joint to insure safety. The operation is tedious and a special tool like a wire stripper is called for, and the efficiency of the wire connection is very low.

SUMMARY OF INVENTION

Therefore the main object of the present invention is to provide a novel device for connecting electrically conductive wires which would eliminate the long recognized necessary step of striping off the insulating coat of the wire to be connected, and which can easily be operated without the aid of any special tool.

Other objects and features of the present invention will become apparent from the following detailed description in conjunction with the annexed drawings.

DETAIL DESCRIPTION OF EMBODIMENT

Figure 1:
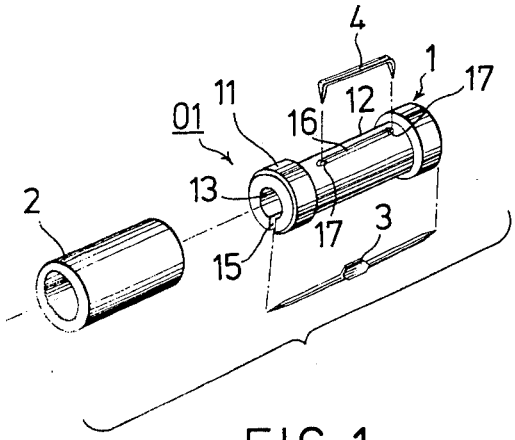
FIG. 1 depicts an exploded perspective view of the wire connector of the present invention.

Now referring to the exploded view of FIG. 1, the wire connector 01 of the present invention comprises an inner socket 1, an outer socket 2, both of which are made of insulating material, and a double ended conducting needle 3 and a fastening spike 4.

Figure 2:
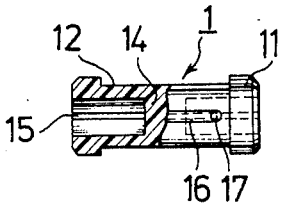
FIG. 2 is a top view of the inner insulating socket with a part cut away.
Figure 4:
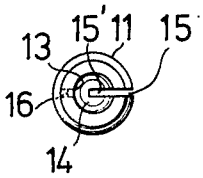
FIG. 4 is a side view of the inner insulating socket.
Figure 3:
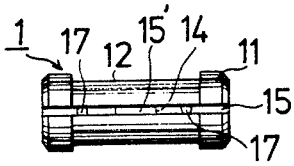
FIG. 3 is a bottom view of the inner insulating socket.
Figure 5:
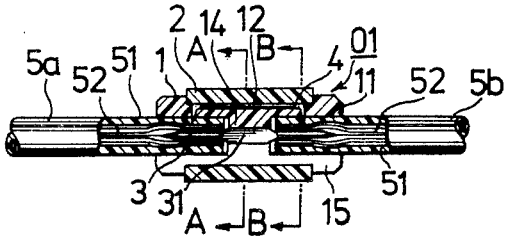
FIG. 5 is a longitudinal section of the wire connector in use, viewed from front.
Figure 7:
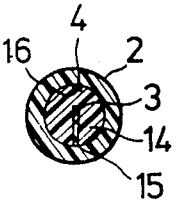
FIG. 7 is a cross section along line A—A in FIG. 5.
Figure 6:
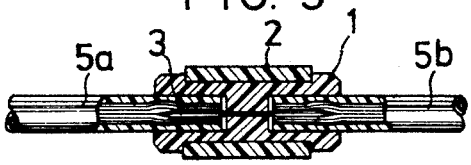
FIG. 6 is a longitudinal section of the wire connector in use, viewed from top.
Figure 8:
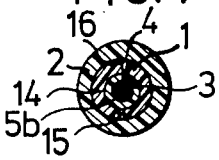
FIG. 8 is a cross section along line B—B in FIG. 5.

Inner insulating socket 1 as shown in FIGS. 2, 3 and 4 has two ends 11—11 of larger diameter and a body portion 12 of smaller diameter. In the middle of the center opening 13 for inserting wires, partition wall 14 is provided to separate the opening 13 into two parts. The said inner socket has a split 15 formed all the way through the full length of opening 13, and in the partition wall 14. The split extends to the center of the partition wall so that the latter serves as a retainer 15′ of the conducting needle 3. On the opposite side of the split 15, on the body 12, a shallow groove 16 is disposed longitudinally. The groove 16 has a length shorter than the body 12 and a depth which is less than the wall thickness of the body 12 so that the groove 16 does not extend through the side wall of the socket. The groove retains a U-shaped spike 4. At both ends of the spike retaining groove 16, holes 17 are provided through the side wall to reach the opening 13. A two ended conducting needle 3 is placed in the center opening 13 of the socket 1, a middle flatened portion of the, needle 3 being inserted from the split 15 into the retainer 15′ of the partition wall 14 and fixed therein (see FIGS. 5 and 6). The needle preferably has a length shorter than that of the socket 1, so that the needle points do not project beyond the ends of socket 1 to avoid hurting the hand of the user. Of course, it would be permissible for the points to project beyond the ends of socket.

The outer insulating socket 2 is simply a tubular cylinder. The length of the socket 2 may be equal to or somewhat smaller than the body 12 of inner socket 1, and the inside diameter of which may be equal to or somewhat smaller than the outside diameter of the body 12 of the inner socket 1. The U shaped spike serves to fasten tightly the two wires to be connected. The center distance between the spike points coincides with the center distance between holes 17. When the spike is applied, it fits into the groove 16 and would not hamper the insertion of socket 2 onto socket 1.

From what I have mentioned above, the inner socket 1, prelaid with the conducting needle 3, the spike 4 and the outer socket 2 constitute the connector 01 of the present invention.

In using the connector 01, first pass any one of the two wires 5*a* and 5*b* to be connected, through outer socket 2. Since the inside diameter of the outer socket 2 is much larger than the outside diameter of wire 5*a* or 5*b*, the wire is slidable freely within the socket 2. Then insert the ends of 5*a* and 5*b* without striping off their insulated coatings into respective ends of opening 13 of the inner socket, the points of conducting needle 3 projecting into the opening 13 would penetrate the conductor core 52 of ends of wires 5*a* and 5*b* and thereby be connected thereto. Apply spike 44 with points pressed into holes 17 of the groove 16. The points of spike would pentrate the coatings 51 and project into cores 52. The last step is to slide outer socket 2, which has already been disposed outside one end of either wire 5*a* or 5*b*, and squeeze it along one end of inner socket 1 and onto the body portion 12 of inner socket 1. The connecting procedure is thereby completed. Since the inner socket 1 is covered by the outer socket 2, the spike 4 would not be exposed. The split 15 thereby snaps tight around the wire ends, and the spike furthers the fastening effect. Thus, a the connection is accomplished surely and effectively.

In the abovementioned embodiment in addition to inner and outer sockets 1 and 2, spike 4 is used to augment the connecting action. In case wires of small diameter are to be connected, spike 4 may be omitted, of course the connecting action will somewhat be reduced.

The above embodiment is given only for illustration purpose and not by way of limitaition, and modification will become evident to those skilled in the art which will fall within the scope of attached claims.

I claim:

1. A connector for connecting electrically conductive wires together comprising:

an inner socket of tubular construction, said inner socket comprising:

a longitudinal opening, a partition wall disposed within said opening dividing said opening into two sections adapted to receive the ends of electrically conductive wires to be connected;

enlarged portions at opposite ends of the inner socket establishing therebetween a portion of reduced cross-section;

a split extending completely through the outer periphery of said inner socket and said enlarged portions;

a shallow groove formed in the outer periphery of said portion of reduced corss-section, said groove extending parallel to the axis of said opening and having holes at the ends thereof communicating with said two sections of said opening;

an outer socket of tubular construction configured to fit around said portion of reduced cross section;

an electrically conductive needle fixedly secured within said partition wall so as to extend axially within said inner sleeve, said needle having points at both ends projecting beyond the partition wall and into the opening sections so as to penetrate the ends of the electrically conductive wires being connected; and a spike insertable in said portion of reduced cross section, said spike including a bight portion sized for reception in said groove, and pointed arm portions positioned to extend through said holes and penetrate the ends of the electrically conductive wires being connected;

said outer socket being insertable around said portion of reduced cross section to cover said spike and tighten said portion of reduced cross section against the ends of the electrically conductive wires being connected.

2. A connector according to claim 1 wherein said split extends radially to the center of said partition, said needle being sized to be inserted through said split and retained at the center of said partition wall.

3. A connector according to claim 1 wherein the length of said needle generally equals the length of said inner socket.

4. A connector according to claim 1 wherein the inner diameter of the outer socket is smaller than the outer diameter of the enlarged end portions of the inner socket.

* * * * *